US011846149B2

(12) United States Patent
Xie et al.

(10) Patent No.: US 11,846,149 B2
(45) **Date of Patent: *Dec. 19, 2023**

(54) CORE SAMPLING AND PRESERVATION SYSTEM

(71) Applicant: SHENZHEN UNIVERSITY, Guangdong (CN)

(72) Inventors: Heping Xie, Guangdong (CN); Mingzhong Gao, Guangdong (CN); Ling Chen, Guangdong (CN); Cunbao Li, Guangdong (CN); Jianbo Zhu, Guangdong (CN); Jun Guo, Guangdong (CN); Zhiyi Liao, Guangdong (CN); Cong Li, Guangdong (CN); Zhiqiang He, Guangdong (CN)

(73) Assignee: SHENZHEN UNIVERSITY, Guangdong (CN)

( * ) Notice: Subject to any disclaimer, the term of this patent is extended or adjusted under 35 U.S.C. 154(b) by 241 days.

This patent is subject to a terminal disclaimer.

(21) Appl. No.: 17/419,059

(22) PCT Filed: Mar. 15, 2019

(86) PCT No.: PCT/CN2019/078288
§ 371 (c)(1),
(2) Date: Feb. 10, 2022

(87) PCT Pub. No.: WO2020/133725
PCT Pub. Date: Jul. 2, 2020

(65) Prior Publication Data

US 2022/0170335 A1 Jun. 2, 2022

(30) Foreign Application Priority Data

Dec. 26, 2018 (CN) ..... 201811596435.1

(51) Int. Cl.
*E21B 25/10* (2006.01)
*E21B 10/02* (2006.01)

(52) U.S. Cl.
CPC ..... *E21B 25/10* (2013.01); *E21B 10/02* (2013.01)

(58) Field of Classification Search
CPC ..... E21B 10/02; E21B 10/605; E21B 25/08; E21B 25/10; E21B 2200/05; E21B 10/26; E21B 10/44; E21B 34/06
(Continued)

(56) References Cited

U.S. PATENT DOCUMENTS 4,071,099 A * 1/1978 Hensel, Jr. ..... E21B 25/005 73/864.91
4,716,974 A * 1/1988 Radford ..... E21B 25/08 175/59
(Continued)

FOREIGN PATENT DOCUMENTS

CN 1948940 A 4/2007
CN 101215959 A * 7/2008
(Continued)

*Primary Examiner* — Taras P Bemko
(74) *Attorney, Agent, or Firm* — NKL LAW; Allen Xue

(57) ABSTRACT

A core sampling and preservation system comprises the following sequentially connected modules: a drive module (300), a preservation module (200) and a core sampling module (100). The core sampling module (100) comprises a core drilling tool and a core sample storage compartment. The preservation module (200) comprises a core sample preservation container. The drive module comprises a core drill having a liquid channel. The core sample preservation container comprises an inner core barrel (28), an outer core barrel (26) and an energy storage device (229). The outer core barrel (26) is sleeved onto the inner core barrel (28). An upper end of the inner core barrel (28) is in communication with a liquid nitrogen storage tank (225). The liquid nitrogen
(Continued)

storage tank (225) is positioned inside the outer core barrel (26). The energy storage device (229) is in communication with the outer core barrel (26). The outer core barrel (26) is provided with a butterfly valve (23). The system facilitates preserving a core at in-situ conditions, and has an increased drilling speed, thereby enhancing core sampling efficiency.

10 Claims, 16 Drawing Sheets

(58) Field of Classification Search
USPC ..... 175/58, 245
See application file for complete search history.

(56) References Cited

U.S. PATENT DOCUMENTS

| | | | | |
|---|---|---|---|---|
| 6,283,228 | B2 * | 9/2001 | Collee | E21B 25/08 175/58 |
| 8,307,704 | B2 * | 11/2012 | Georgi | G01V 9/00 73/152.07 |
| 9,828,820 | B2 * | 11/2017 | Gupta | G01V 5/04 |

FOREIGN PATENT DOCUMENTS

| | | | | |
|---|---|---|---|---|
| CN | 106124242 | A | | 11/2016 |
| CN | 106932223 | A | * | 7/2017 |
| CN | 109025874 | A | | 12/2018 |
| RU | 2200225 | C2 | | 3/2003 |
| RU | 2209912 | C1 | | 8/2003 |

* cited by examiner

CORE SAMPLING AND PRESERVATION SYSTEM

TECHNICAL FIELD

The present invention relates to the field of oil and gas field exploration, and in particular to a core sampling and preservation system.

BACKGROUND ART

In the process of oilfield exploration, rock core is the key material for discovering oil and gas reservoir, as well as studying stratum, source rock, reservoir rock, cap rock, structure, and so on. Through the observation and study of the core, the lithology, physical properties, as well as the occurrence and characteristics of oil, gas, and water can be directly understood. After the oilfield is put into development, it is necessary to further study and understand the reservoir sedimentary characteristics, reservoir physical properties, pore structure, wettability, relative permeability, lithofacies characteristics, reservoir physical simulation, and reservoir water flooding law through core. Understanding and mastering the water flooded characteristics of reservoirs in different development stages and water cut stages, and finding out the distribution of remaining oil can provide scientific basis for the design of oilfield development plan, formation system, well pattern adjustment, and infill well.

Coring is to use special coring tools to take underground rocks to the ground in the process of drilling, and this kind of rock is called core. Through it, various properties of rocks can be determined, underground structure and sedimentary environment can be studied intuitively, and fluid properties can be understood, etc. In the process of mineral exploration and development, the drilling work can be carried out according to the geological design of strata and depth, and coring tools were put into the well, to drill out core samples and store in the core storage chamber. In the process of equipment rise, the temperature, pressure and other environmental parameters of core storage chamber will be reduced, so that the core can not maintain its state of in-situ conditions.

The coring tool comprises a coring drilling tool and a core catcher. After the coring drilling tool is cut into the stratum, a core catcher makes the core keep in the inner barrel. The core catcher in the prior art can only take soft rock, by which it is difficult to take hard rock. In addition, the coring drilling tool has a slow blade-cooling speed, fast tool wear, and a short service life.

The downhole temperature is high, and electrical equipment cannot be used, thus hydraulic equipment is often used. Before starting the hydraulic equipment, the liquid channel should be blocked. After starting, the liquid channel should be unblocked to provide hydraulic pressure for the working parts, drive the hydraulic motor and cool the drill bit.

CONTENT OF THE INVENTION

The present invention aims to provide a core sampling and preservation system, which is beneficial for maintaining the in situ conditions of the core, and can improve the drilling speed and the coring efficiency. Before the liquid channel starting mechanism is started, the liquid channel should be blocked; after starting, hydraulic pressure is supplied to the working parts.

To achieve the above objective, the present invention is realized by the following technical solutions: A core sampling and preservation system disclosed in the present invention comprises the following sequentially connected modules: a drive module, a preservation module and a core sampling module. The core sampling module comprises a core drilling tool and a core sample storage compartment. The preservation module comprises a core sample preservation container. The drive module comprises a core drill having a liquid channel;

the core drilling tool comprises a coring drill tool, a core catcher, and an inner core pipe; the coring drill tool comprises an outer core pipe and a hollow drill bit, and the drill bit is connected to the lower end of the outer core pipe; the core catcher comprises an annular base and a plurality of claws, the annular base is coaxially mounted on the inner wall of the lower end of the inner core pipe, and the claws are uniformly arranged on the annular base. The lower end of the claws is connected with the annular base, and the upper end of the claws is closed inward; the lower end of the inner core pipe extends to the bottom of the outer core pipe, and the inner core pipe is in clearance fit with the outer core pipe;

said core sample storage compartment comprises a rock core barrel, a drilling machine outer cylinder, a flap valve and a trigger mechanism. The flap valve comprises a valve seat and a sealing flap, the valve seat is coaxially mounted on the inner wall of the drilling machine outer cylinder, and one end of the sealing flap is movably connected to the outer sidewall of the upper end of the valve seat; the top of the valve seat is provided with a valve port sealing surface matched with the sealing flap. The rock core sample preservation container comprises an inner core barrel, an outer core barrel, and an energy storage device. The outer core barrel is sleeved on the inner core barrel; the upper end of the inner core barrel is communicated with a liquid nitrogen storage tank, and the liquid nitrogen storage tank is located in the outer core barrel; the energy storage device is communicated with the outer core barrel; the outer core barrel is provided with a flap valve;

said liquid channel includes a liquid channel starting mechanism, which consists of a lock body, a locking rod, a shear pin, and a central rod. The lock body penetrates from the front to the back, and the lock body is sequentially composed of a locking section, a sealing section, and a liquid channel section from back to front. The side wall of the locking section is provided with a shear pin hole, which is a through hole. The locking rod also penetrates from the front to the back, and is in the lock body. The locking rod sequentially comprises a connecting section, an outflow section, a closed section, and an inflow section from back to front. There are grooves on the outer wall of the connecting section. The length of the shear pin is greater than the depth of the shear pin hole on the side wall of the lock body. The shear pin is in the shear pin hole and the groove. The side wall of the outflow section is provided with an outflow hole, and the side wall of the inflow section is provided with an inflow hole. The central rod is in the locking rod. The inner diameter of the sealing section is equal to the outer diameter of the closed section. The inner diameter of the liquid channel section is greater than the outer diameter of the locking rod, and the inner diameters of the connecting section, the outflow section and the inflow section are greater than the outer diameter of the central rod. The inner diameter of the closed section is equal to the outer diameter of the central rod, and the axial distance from the front end of the sealing section to the rear end of the lock body is less than the axial distance from the front end of the closed section to the rear end of the lock body. The inner cavity of the liquid channel section is communicated with the inner cavity of the inflow section by the inflow hole. The shear pin is inserted into the groove through the shear pin hole. The axial distance from the outer wall opening of the outflow hole to the rear end of the lock body is less than the axial distance from the rear end of the liquid channel section to the rear end of the lock body.

Further, said core sample preservation container further comprises an electric heater, a temperature sensor, an electric control valve arranged between the inner core barrel and the liquid nitrogen storage tank, a pressure sensor, and a three-way stop valve A arranged between the energy storage device and the outer core barrel. The two ways of the three-way stop valve A are respectively connected with the energy storage device and the outer core barrel, while the third way of the three-way stop valve A is connected with a pressure relief valve, and the stop valve A is an electrically controlled valve. The temperature sensor and the pressure sensor are connected to the processing unit, and the electric heater, the electric control valve and the three-way stop valve A are all controlled by the processing unit. The electric heater is used to heat the inside of the outer core barrel, the temperature sensor is used to detect the temperature in the preservation container, and the pressure sensor is used to detect the pressure in the preservation container.

Preferably, the drill bit includes a first-stage blade for drilling and a second-stage blade for reaming. The drill bit comprises an inner drill bit and an outer drill bit. The inner drill bit is installed in the outer drill bit, and the first-stage blade is located at the lower end of the inner drill bit, while the secondary blade is located on the outer sidewall of the outer drill bit. The first-stage blades are provided with three at equal intervals in the circumferential direction, and the second-stage blades are also provided with three at equal intervals in the circumferential direction, and both the first-stage blades and the second-stage blades on the drill bit are provided with coolant circuit holes.

Preferably, the outer core pipe and the outer wall of the drill bit are both provided with a spiral groove, and the spiral groove on the drill bit is continuous with that on the outer core tube.

Preferably, the claw comprises a vertical arm and a tilt arm which are integrally manufactured. The lower end of the vertical arm is connected with the annular base, while the upper end of the vertical arm is connected with the lower end of the tilt arm. The upper end of the tilt arm is a free end, and the tilt arm tilts inward from bottom to top, with a tilt angle of 60°.

Preferably, the sealing valve flap includes an elastic sealing ring, elastic connecting strips, sealings, and a plurality of locking strips arranged in parallel; the elastic connecting strip connects all the locking strips in series, and the elastic sealing ring loops all the locking strips together, to form an integral structure. The locking strip is provided with a groove adapted to the elastic sealing ring, and the elastic sealing ring is installed in the groove. There is a sealing between two adjacent locking strips. One end of the valve flap is movably connected to the upper end of the valve seat through a limit hinge; the valve flap is curved when it is not turned down, and the valve flap is attached to the outer wall of the inner core barrel; the valve flap is flat when it is turned down and covers the upper end of the valve seat.

Further, the inner wall of the outer core barrel is provided with a sealing cavity, and the flap plate is located in the sealing cavity. The sealing cavity is in communication with the inner core barrel. The inner wall of the outer core barrel is provided with a sealing ring, which is located below the flap valve. Preferably, the electric heater is a resistance wire, which is embedded in the inner wall of the outer core barrel, and coated with an insulating layer; a graphene layer is covered on the inner wall of the inner core barrel; the upper part of the inner core barrel is filled with a drip film-forming agent. Preferably, the inner diameter of the locking section is greater than the inner diameter of the sealing section. The outer wall of the connecting section has a convex part, whose outer diameter is greater than the inner diameter of the sealing section. The outer diameter of the connecting section in front of the convex part is equal to the inner diameter of the sealing section, and the groove is in the convex part. The outflow hole is inclined forward from the inside to the outside. The connecting section is screwed with the outflow section, and the closed section and the inflow section are welded together. After starting, the locking rod moves forward, and the shear pin is cut. The shear pin head is in the shear pin hole, and the shear pin tail is in the groove. The shearing pin head includes a big head and a small head, and the big head faces outward. The outer diameter of the big head is greater than that of the small head. The shear pin hole includes an outer section and an inner section. The aperture of the outer section is not less than the outer diameter of the big head of the shear pin head, and the aperture of the inner section is not less than the outer diameter of the small head of the shear pin head. The aperture of the inner section is less than the outer diameter of the big head. The depth of the outer section is not less than the length of the big head, and the sum of the length of the small head and the tail of the shear is greater than the depth of the inner section.

Further, said starting mechanism also includes a lock nut. The lock nut is behind the lock body, and the lock nut penetrates back and forth. The central rod passes through the inner cavity of the lock nut, and the front end of the lock nut is threadedly connected with the rear end of the lock body. The shear pin hole opens at the rear end thread of the lock body. The radial distance from the inner wall of the lock nut to the bottom of the groove is not less than the length of the shear pin. The lock nut includes a fixing section and a threaded section. The outer diameter of the connecting section behind the convex part is shorter than the inner diameter of the fixing section, and also shorter than the outer diameter of the convex part, while the inner diameter of the threaded section is equal to the outer diameter of the locking section. Said lock nut is axially provided with a locking hole A, which is the shear pin hole. The lock body has a locking hole B on the rear face, but the locking hole B is a blind hole. The locking hole A and the locking hole B are paired. A fixing screw is also included, and the length of the fixing screw is greater than the depth of the locking hole A. The fixing screw is in the locking hole A, and the front end of the fixing screw is inserted into the locking hole B through the locking hole A. There are a plurality of outflow holes, which are uniformly distributed along a radial circumference. There are also a plurality of inflow holes, which are distributed forward and backward on different side surfaces.

The present invention has the following beneficial effects:

1. In the present invention, the preservation container can be automatically heated and cooled, which is beneficial for the core to maintain its in situ conditions.
2. In the present invention, the preservation container can be automatically pressured, which is beneficial for the core to maintain its in situ conditions.
3. The flap mechanism of the present invention can automatically close the preservation container when the coring is completed, and has a simple structure, safety and reliability.
4. The graphene layer of the present invention can reduce the sliding resistance of the core on the inner side of the PVC pipe, improve the strength and surface accuracy of the inner side, and enhance the thermal conductivity coefficient and the like.
5. The sealing cavity of the present invention can isolate the drilling fluid passing through the preservation container.
6. In the present invention, a mechanical claw that faces upwards and is folded inward is designed. When the claws go down, the claws are easily propped up by the core, so that the core enters the inner core barrel; when the claws go up, it is difficult for claws to be stretched by the rock core, and because the rock core cannot resist the greater pulling force and the clamping action of the claws, the rock core is broken at the claws, and the broken core will continue to move up with the claws and remain in the inner barrel.
7. In the present invention, the drill bit is divided into two-stage blades, the bottom blade drills a small hole first, and then the upper blade expands the hole, so as to improve the drilling speed and the coring efficiency.
8. In the present invention, a through hole is provided in the blade part as a coolant circuit hole, and the coolant can be sprayed out through the through hole to cool the blade, speed up the cooling rate of the blade, reduce the wear of the tool, and extend the life of the blade.
9. The outer wall of the outer core tube is provided with a spiral groove continuous with that of the drill bit, and as the outer core tube is screwed into the rock formation, the outer core tube creates a closed space for the coring tool, which can prevent the preservation container from being contaminated.
10. Before starting, the shear pin fixes the locking rod, and the outflow hole is in the sealing section. The outer wall opening of the outflow hole is sealed, and the fluid cannot flow out. When the hydraulic pressure provided by the rear mud pump reaches the starting value, the shear pin is broken, and the locking rod moves forward. The fluid flows through the liquid channel formed by the outer wall of the central rod and the inner wall of the connecting section and the inner wall of the outflow section, enters the liquid channel formed by the inner wall of the liquid channel section and the outer wall of the inflow section through the outflow hole, and moves into the liquid channel formed by the outer wall of the central rod and the inner wall of the inflow section through the inflow hole, which is connected to the hydraulic motor and the drill bit ahead, so that the hydraulic motor is started, and the drill bit is cooled.
11. The outer diameter of the convex part is greater than the inner diameter of the sealing section, which limits the forward movement distance of the locking rod, so that the locking rod will not move forward after reaching the working position.
12. A lock nut is set and connected with the lock body, and the connecting section is threaded with the outflow section, that is convenient for installation and replacement of the shear pin.
13. The locking holes A and B are matched with the fixing screws to limit the circumferential rotation.
14. The shear pin head includes a big head and a small head, and the shear pin hole includes an outer section and an inner section, that can limit the radial inward movement of the shear pin.

EXAMPLES

In order to make the objectives, technical solutions, and advantages of the present invention clearer, the present invention will be further illustrated hereinafter by combing with the attached Figures.

Figure 1:
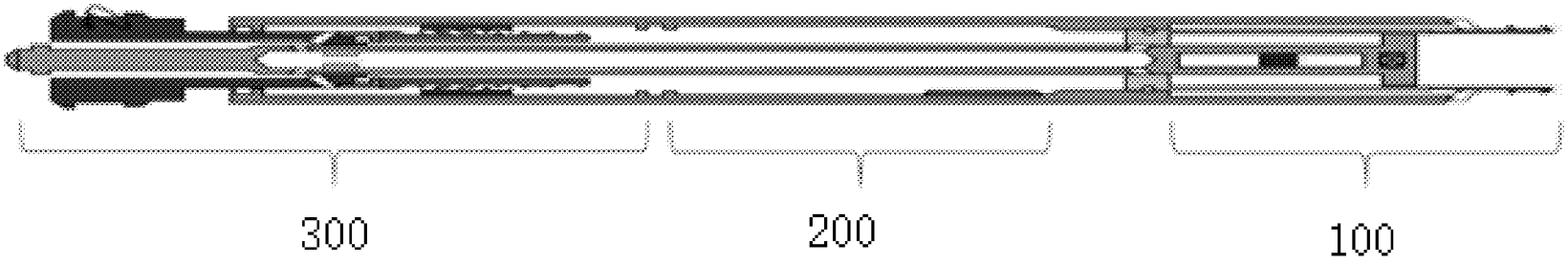
FIG. 1. The structural schematic diagram of the present invention.

As shown in FIG. 1, A core sampling and preservation system disclosed in the present invention comprises the following sequentially connected modules: a drive module 300, a preservation module 200 and a core sampling module 100. The core sampling module comprises a core drilling tool and a core sample storage compartment. The preservation module comprises a core sample preservation container. The drive module comprises a core drill having a liquid channel.

Figure 2:
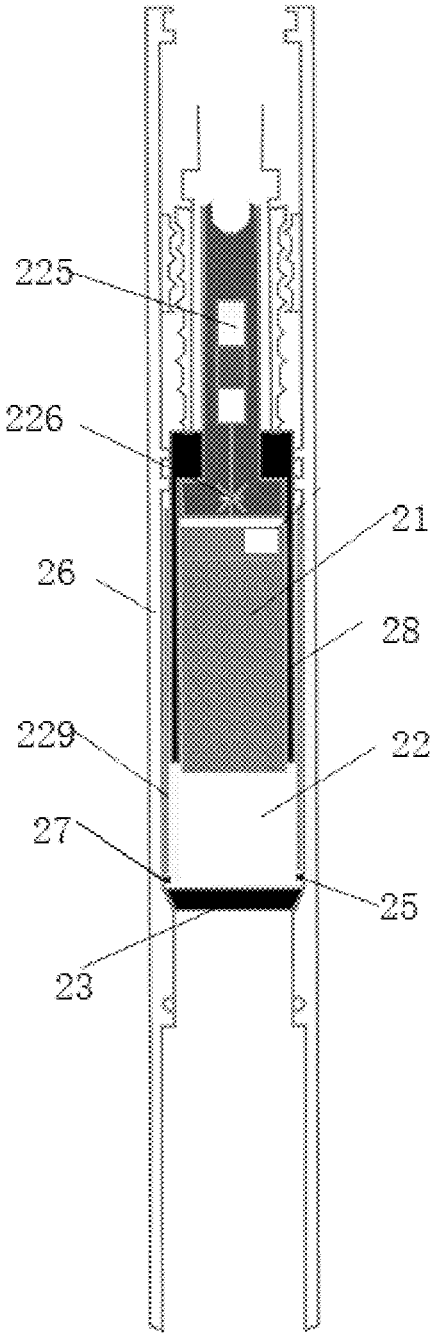
FIG. 2. The structural schematic diagram of the core sample preservation container.

As shown in FIG. 2, the core sample preservation container comprises a mechanical part and a control part. The mechanical part includes an inner core barrel 28, an outer core barrel 26 and an energy storage device 229. The energy storage device 229 is connected to the outer core barrel, and the inner core barrel 28 is used to place the rock core 21, and the outer core barrel 26 is sleeved on the inner core barrel 28. The upper end of the inner core barrel 28 is connected to the liquid nitrogen storage tank 225. An electric control valve 226 is arranged on the communication pipeline between the inner core barrel 28 and the liquid nitrogen storage tank 225. The liquid nitrogen storage tank 225 is located in the outer core barrel 26, and the outer core barrel 26 is provided with a flap valve 23.

Figure 3:
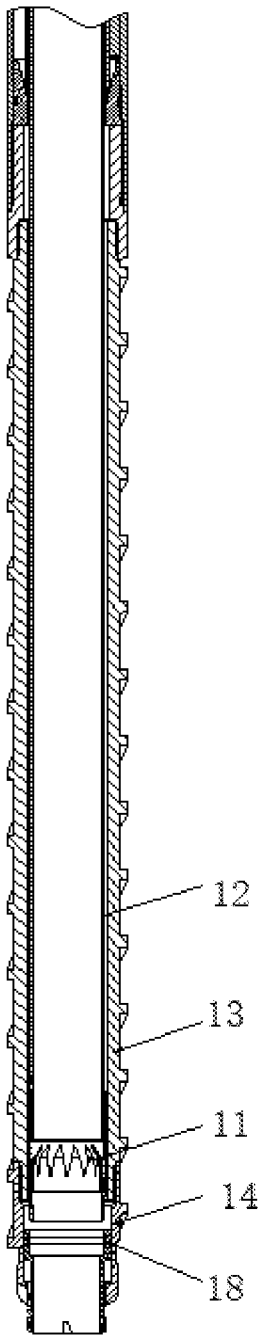
FIG. 3. The structural schematic diagram of the rock core drilling tool.
Figure 8:
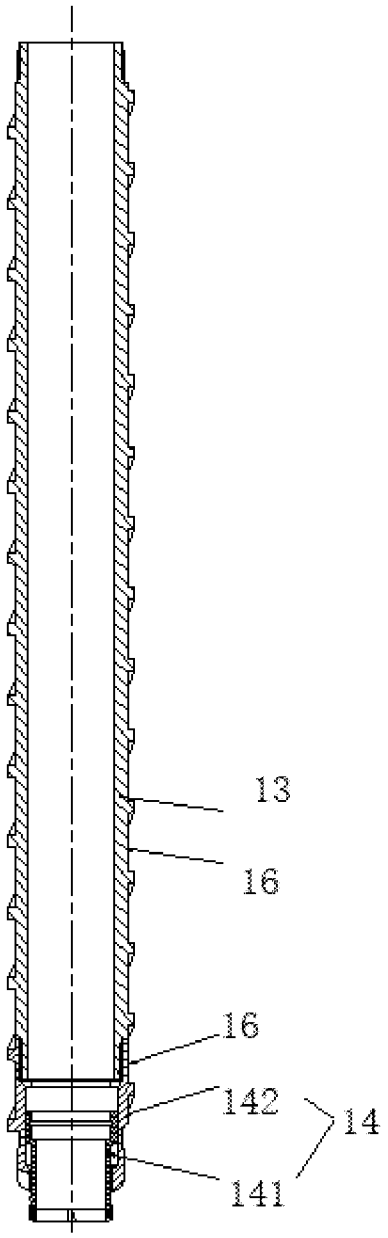
FIG. 8. The structural schematic diagram of the coring drilling tool.

As shown in FIGS. 3 and 8, the rock core drilling tool comprises a coring drilling tool, a core catcher 11, and an inner core pipe 12. The coring drilling tool comprises an outer core pipe 13 and a hollow drill bit 14, and the drill bit 14 is connected to the lower end of the outer core pipe 13. The core catcher 11 is mounted on the inner wall of the lower end of the inner core pipe 12. The lower end of the inner core pipe 12 extends to the bottom of the outer core pipe 13 and is in clearance fit with the outer core pipe 13.

Figure 6:
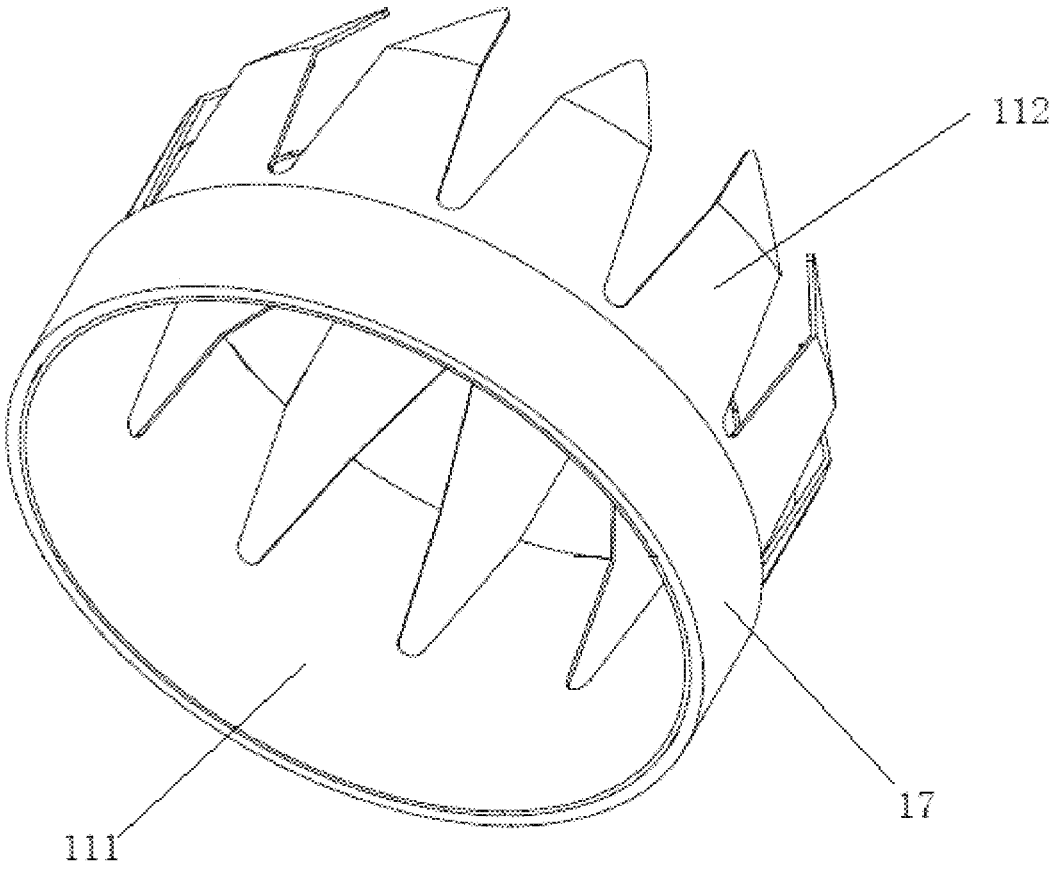
FIG. 6. 3D drawing of the core catcher.
Figure 7:
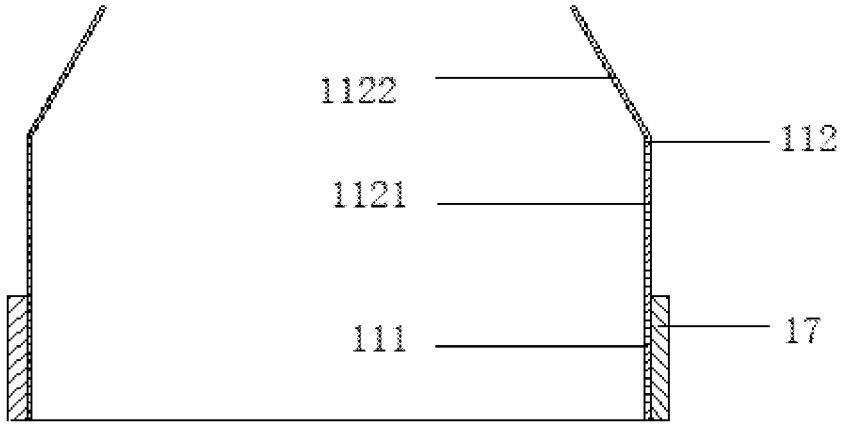
FIG. 7. Sectional view of the core catcher.

As shown in FIGS. 6 and 7, the core catcher 11 includes an annular base 111 and a plurality of claws 112. The claws 112 are evenly arranged on the annular base 111. The lower ends of the claws 112 are connected with the annular base 111, while the upper ends of the claws 112 are folded inward. There are 8~15 claws 112, preferably 12 claws 112. The number of claws 112 can be set as required, and is not limited to those listed above.

The claw 112 includes integrally manufactured vertical arm 1121 and tilt arm 1122. The lower end of the vertical arm 1121 is connected with the annular base 11, while the upper end of the vertical arm 1121 is connected with the lower end of the tilt arm 1122, and the upper end of the tilt arm 1122 is a free end. The tilt arm 1122 is inclined inward from bottom to top, and the inclination of the tilt arm 1122 can be adjusted as required. In this example, the tilt angle of the tilt arm 1122 is 60°, and the width of the claw 112 gradually decreases from bottom to top.

Figure 4:
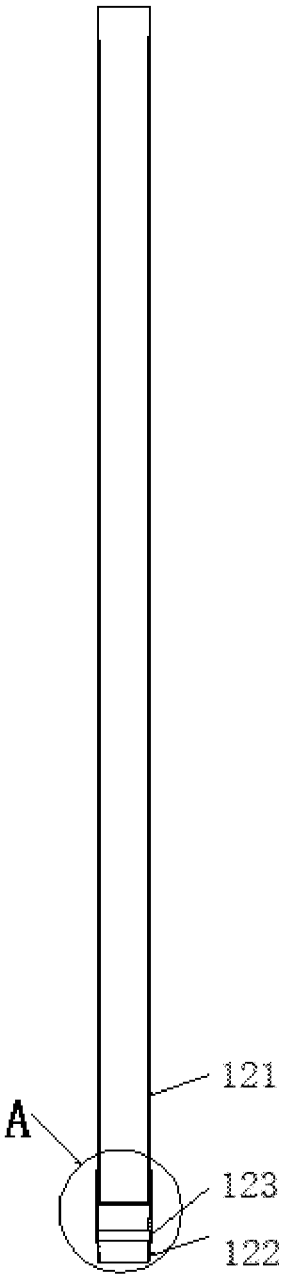
FIG. 4. The structural schematic diagram of the inner core pipe.
Figure 5:
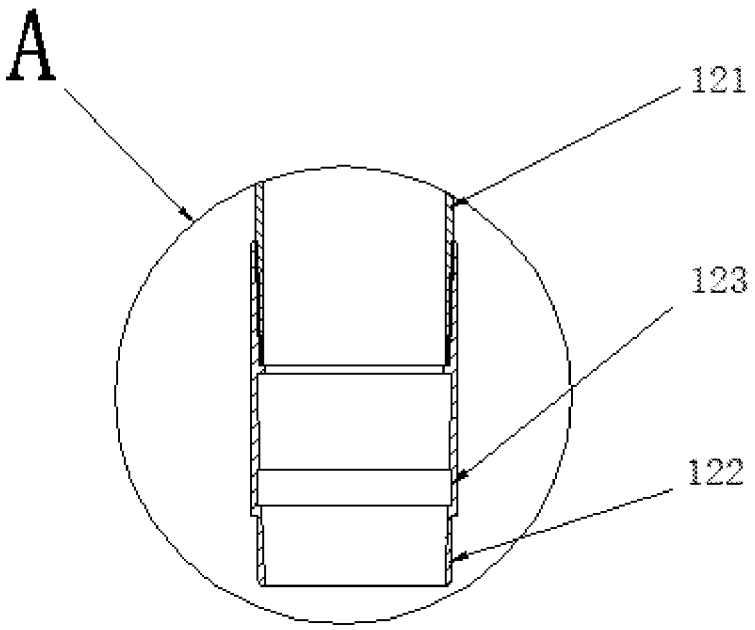
FIG. 5. An enlarged view of A in FIG. 3.

Wherein, the thickness of the claw 112 is equal to the thickness of the annular base 111, and the claw 112 is manufactured integrally with the annular base 111. The annular base 111 is sheathed with an annular sleeve 17, and both of annular base 111 and annular sleeve 17 are fixedly connected. The inner wall of the inner core pipe 12 is coated with graphene. As shown in FIGS. 4 and 5, the inner core pipe 12 comprises a core barrel 121 and a core casing 122. The upper end of the core casing 122 is fixed at the lower end of the core barrel 121. The inner wall of the core casing 122 is provided with an annular groove 123 adapted to the annular sleeve 17. The annular sleeve 17 is installed in the annular groove 123, and the free end of the claws 112 faces upward. The free end of the claws 112 faces upwards and inwards, and when the core passes through the hard core catcher 11 from bottom to top, the claws 112 are easily stretched, while it is difficult from top to bottom.

Figure 9:
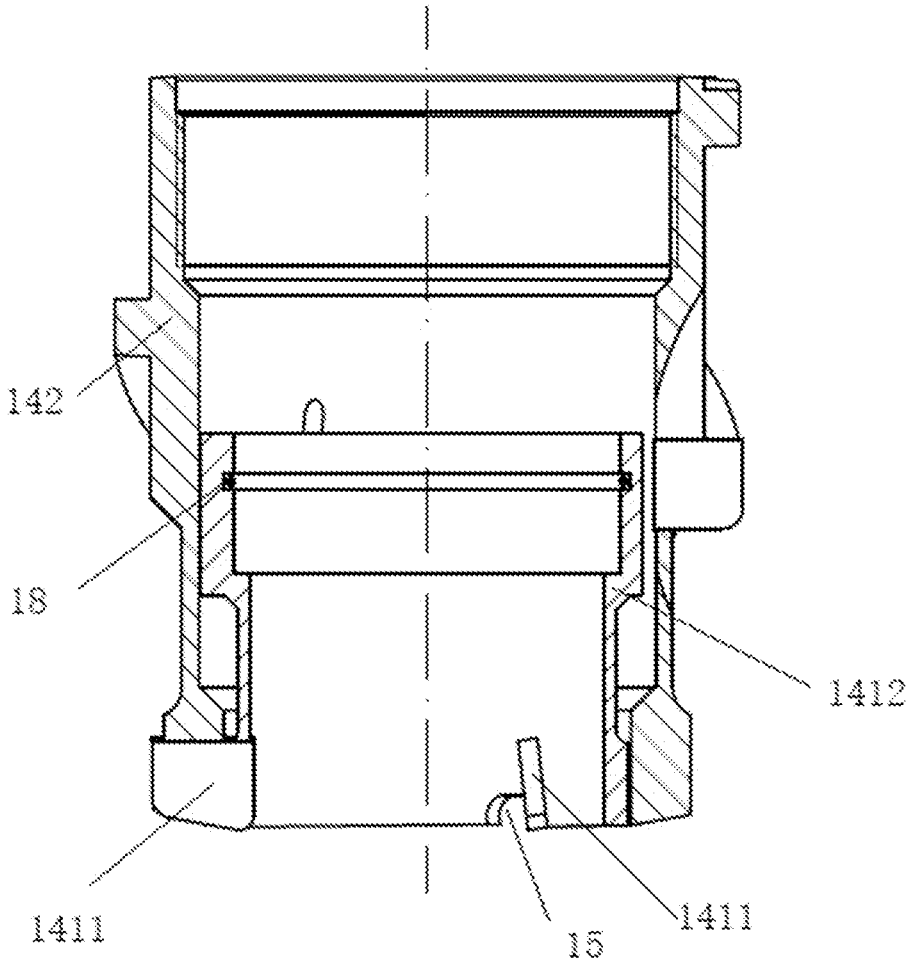
FIG. 9. The structural schematic diagram of the drill bit.
Figure 10:
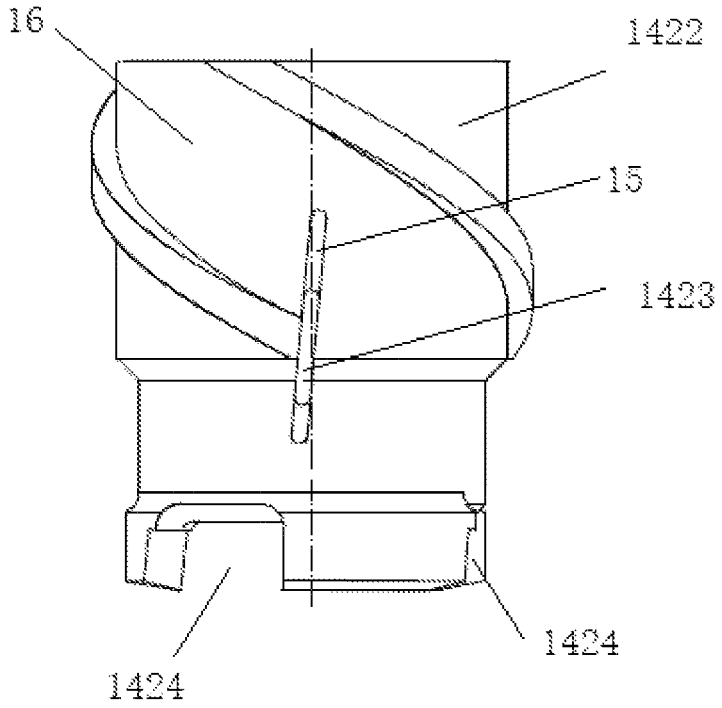
FIG. 10. The structural schematic diagram of the outer drilling cutter body.
Figure 11:
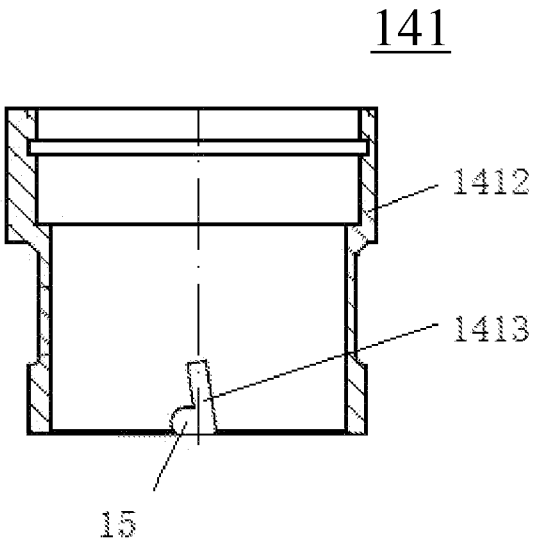
FIG. 11. The structural schematic diagram of the inner drilling cutter body.

The drill bit 14 is a PCD tool. As shown in FIGS. 8 and 9, the drill bit 14 comprises an inner drill bit 141 and an outer drill bit 142, and the inner drill bit 141 includes a first-stage blade 1411 and a hollow inner drill body 1412. As shown in FIG. 10, the lower end of the inner drill body 1412 is provided with a first-stage blade installation groove 1413 for installing the first-stage blade 1411. The first-stage blade installation groove 1413 is opened on the lower end surface of the inner drill body 1412, on which the first stage blade installation groove 1413 is provided with a coolant circuit hole 15, that is an arc-shaped hole. The arc-shaped hole opens on the front end surface of the drill bit 4 and communicates with the first-stage blade installation groove 1413. The inner drill body 1412 is provided with three first-stage blade mounting grooves 1413 at equal intervals in the circumferential direction. Each first-stage blade mounting groove 1413 is provided with a coolant circuit hole 15, and a first-stage blade 1411 is installed in each first-stage blade mounting groove 1413.

The outer drill bit 142 comprises a second-stage blade 1421 and a hollow outer drill body 1422. As shown in FIG. 10, the outer wall of the second-stage blade 1421 is provided with a second-stage blade installation groove 1423 for installing the second-stage blade 1421, and the second-stage blade installation groove 1423 on the outer drill body 1422 is provided with a coolant circuit hole 15, which is a bar-shaped hole. The bar-shaped hole communicates with the second-stage blade installation groove 1423. The outer drill body 1422 is provided with three second-stage blade installation grooves 1423 at equal intervals in the circumferential direction, and each second-stage blade installation groove 1423 is provided with a coolant circuit hole 15, and each second-stage blade 1421 is installed in each second-stage blade installation groove 1423.

The inner drill bit 141 is installed inside the outer drill bit 142, and the outer drill body 1422 has a first-stage blade avoidance notch 1424 at a position corresponding to the first-stage blade 1411. The first-stage blade avoidance notch 1424 opens on the front end of the outer drill bit 142. The cutting edge of the first-stage blade 1411 is exposed from the outer drill body 1422 by the first-stage blade avoidance notch 1424.

The inner wall of the inner drill body 1412 is provided with a seal ring 18, and the seal ring 18 is located above the first-stage blade 1411. Using a highly elastic annular sealing ring, the rock core can be wrapped in the process of coring, so as to achieve the effect of isolation and quality assurance, as well as realize the objectives of moisturizing and guaranteeing the quality.

As shown in FIGS. 3, 8, and 10, both the outer core tube 13 and the outer wall of the outer drill body 1422 are provided with spiral grooves 6, and the spiral groove 16 on the outer drill body 1422 is continuous with the spiral groove 16 on the outer core tube 13. The outer core tube 16 with the spiral groove 13 on the outer wall is equivalent to a spiral outer drill. As the outer core tube 13 is screwed into the rock formation, the outer core tube 13 creates a closed space for the coring tool. During the coring process, the sealing ring 18 wraps the core, to prevent contamination of the preservation container.

Figure 12:
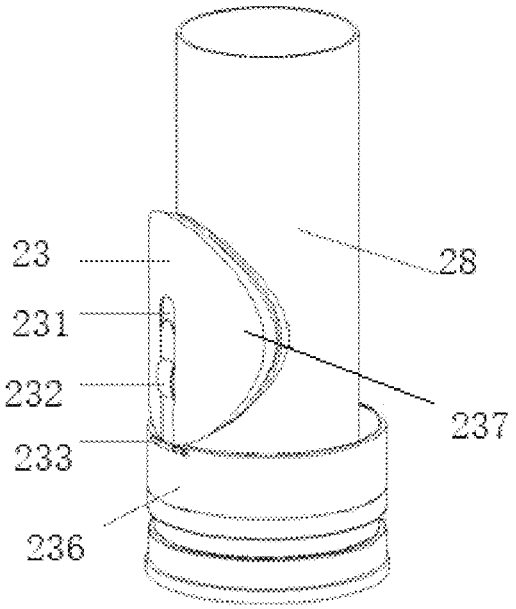
FIG. 12. The structural schematic diagram of the flap valve when it is not turned down.
Figure 13:
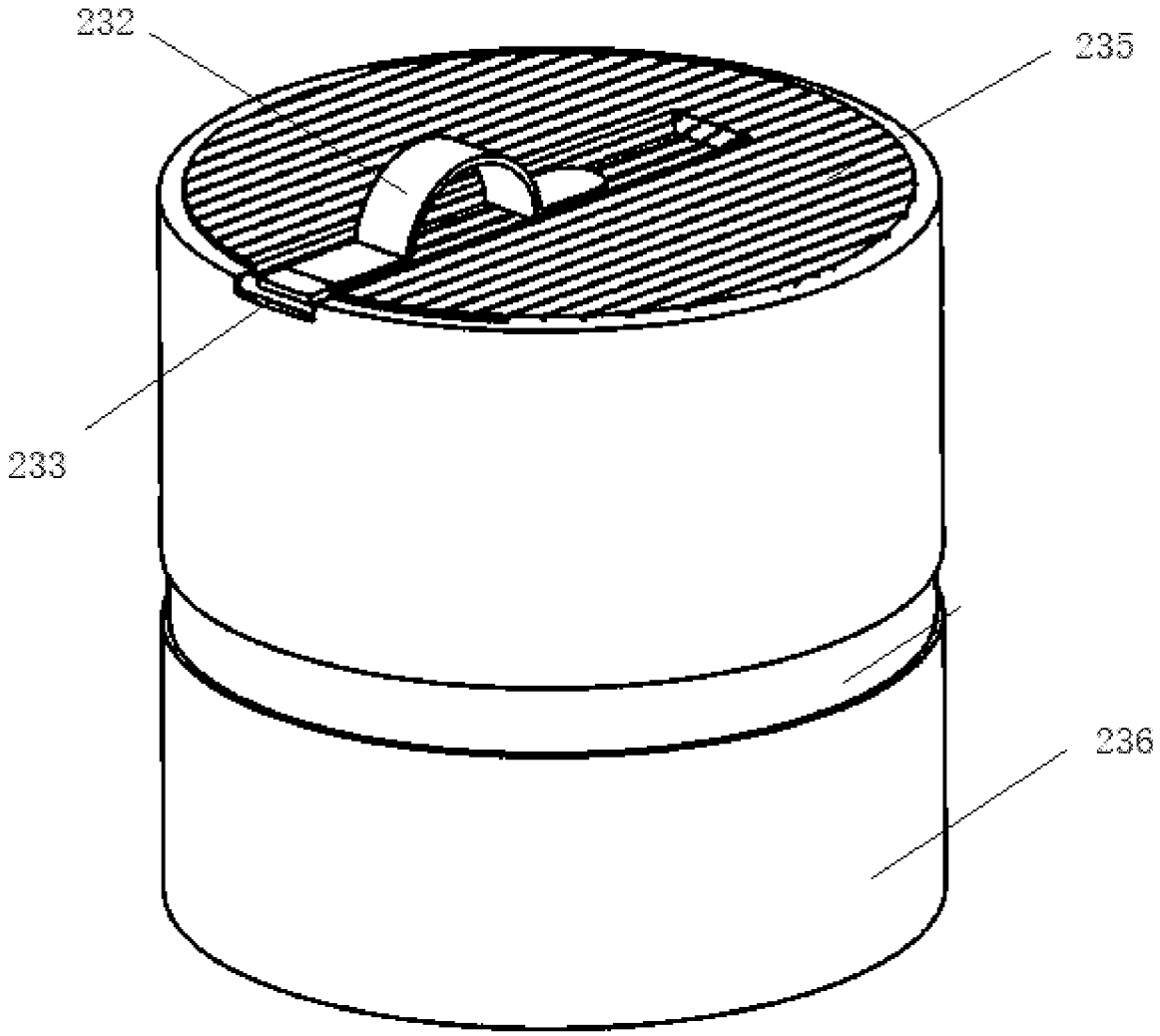
FIG. 13. The structural schematic diagram of the flap valve when it is turned down.
Figure 14:
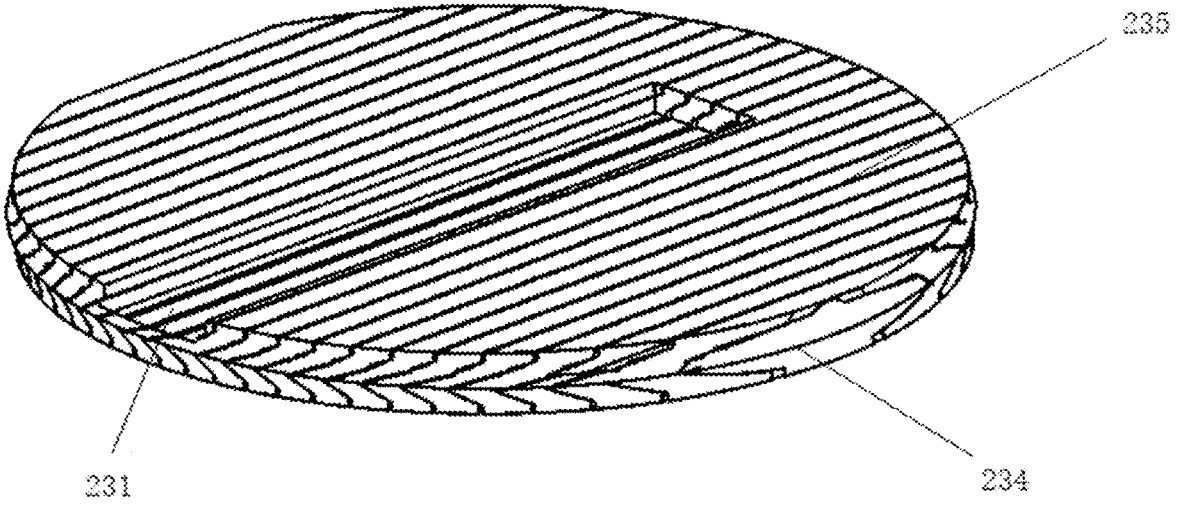
FIG. 14. The structural schematic diagram of the valve flap.

During operation, as the drilling of the drill bit 14, the rock core enters the inner core pipe 12 and passes through the middle of the core catcher 1. When the core passes through the hard claw 112, the claw 112 will be opened; when the drill is stopped and pulled upward, the claw 112 will move upward with the inner core pipe 12. Because the free end of the claw 112 retracts, at this time, it is difficult for the claw 112 to be stretched by the core. Because the core is unable to resist the great pulling force, and the free end of the claw 112 are clamped inward, the core is broken at the site of claw 112, and the broken core will continue to ascend with the claw 112 so as to remain in the inner core pipe 12. As shown in FIGS. 12, 13 and 14, the flap valve 23 includes a valve seat 236 and a valve flap 237. The valve flap 237 includes an elastic sealing ring 234, elastic connecting strips 232, sealings, and a plurality of locking strips 235 arranged in parallel. The elastic connecting strip 232 connects all the locking strips in series, and the elastic sealing ring 234 loops all the locking strips 235 together, to form an integral structure. The locking strip 235 is provided with a groove 231 adapted to the elastic sealing ring, and the elastic sealing ring 234 is installed in the groove 231. There is a sealing between two adjacent locking strips 235. One end of the valve flap 23 is movably connected to the upper end of the valve seat 236 through a limit hinge 233; the valve flap 237 is curved when it is not turned down, and the valve flap 237 is attached to the outer wall of the inner coring barrel 28; the valve flap 237 is flat when it is turned down and covers the upper end of the valve seat 236.

Figure 15:
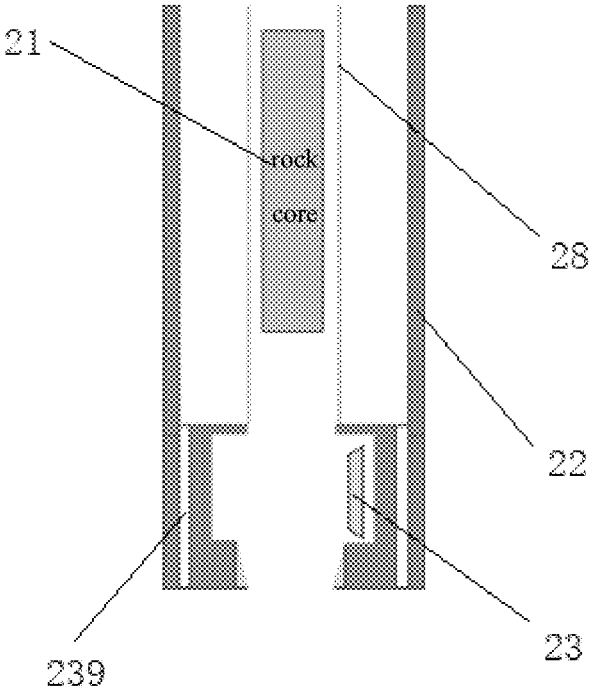
FIG. 15. The structural schematic diagram of the sealing cavity.

As shown in FIG. 15, the inner wall of the outer core barrel 26 is provided with a sealing cavity 239, which is in communication with the inner core barrel 28.

Figure 16:
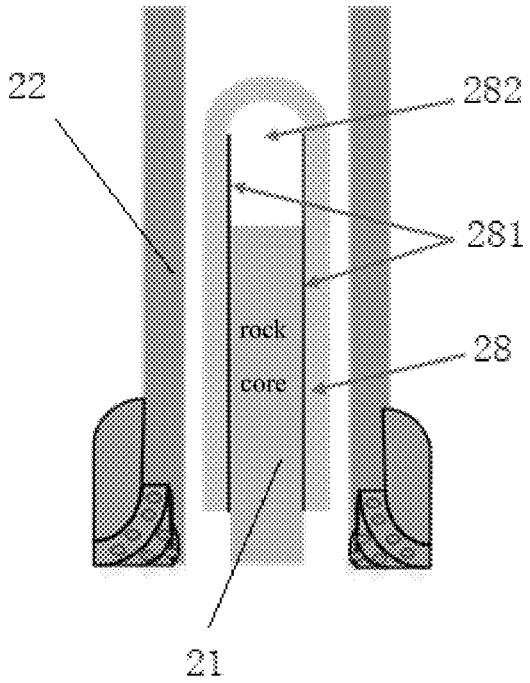
FIG. 16. A partial cross-sectional view of the inner core barrel.

As shown in FIG. 16, the inner core barrel 28 is made of PVC material, and a graphene layer 281 is covered on the inner wall of the inner core barrel 28. The upper part of the inner core barrel 28 is filled with a drip film-forming agent 282.

Figure 17:
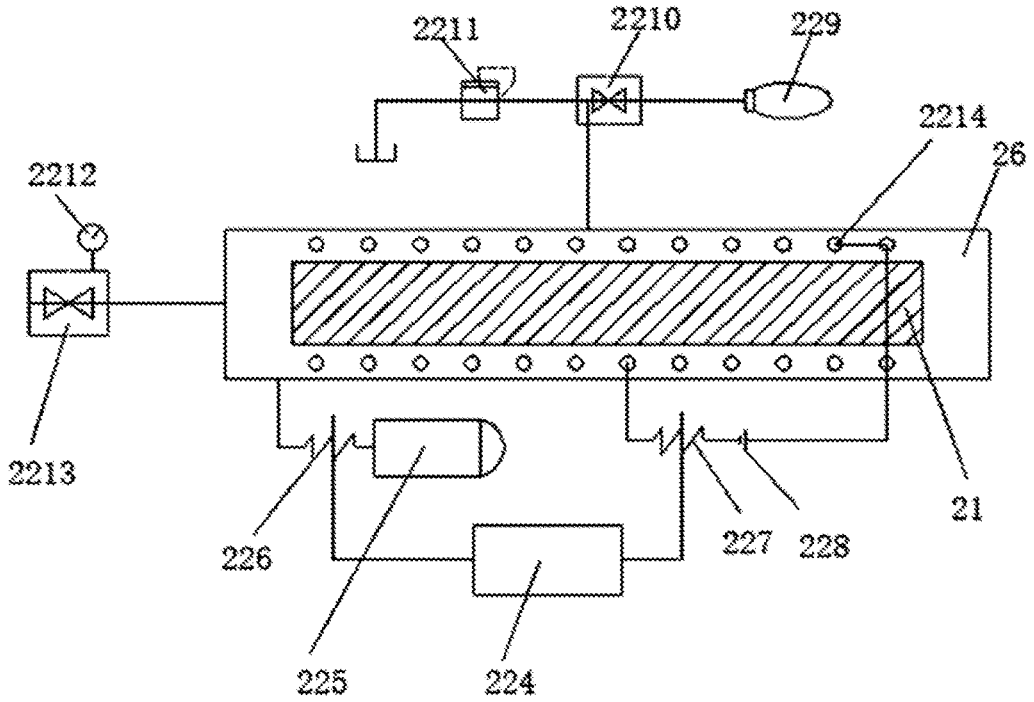
FIG. 17. The electrical schematic diagram of the present invention.

As shown in FIG. 17, the controlling unit comprises an electric heater 2214, a temperature sensor 25, and an electric control valve 226 arranged in the pipe. The temperature sensor 25 is connected to the processing unit 224. The electric heater 2214 is connected to the power supply 228 through a switch 227. The switch 227 and the electric control valve 226 are controlled by the processing unit 224. The electric heater is used to heat the inside of the outer core barrel, and the temperature sensor 25 is used to detect the temperature in the preservation container. Electric heater 2214 is resistance wire, which is embedded in the inner wall of the outer core barrel and coated with insulation layer. The power supply 228 of the control part is located on the outer core barrel. The controlling unit also comprises a pressure sensor 27 and a three-way stop valve A 2210. The two ways of the three-way stop valve A2210 are respectively connected with the energy storage device 229 and the outer core barrel 26, while the third way of the three-way stop valve A2210 is connected with a pressure relief valve 2211. The stop valve A2210 is an electrically controlled valve. The pressure sensor 27 and the three-way stop valve A2210 are both connected to the processing unit 224. The pressure sensor 27 is used to detect the pressure in the preservation container.

In the present invention, the device also includes a pressure gauge 2212, which is connected to the outer core barrel by the three-way stop valve B 2213.

The temperature in the preservation container is detected in real time by the temperature sensor, and compared with the in-situ temperature of the core previously measured. According to the difference between the two temperatures, the electric heater is controlled to heat or the electric control valve is controlled to open to inject liquid nitrogen into the preservation container for cooling, so that the temperature in the constant preservation container is the same as the in-situ temperature of the core. The pressure in the preservation container is detected in real time by the pressure sensor, and compared with the in-situ pressure of the core previously measured. The on-off of the three-way stop valve A is controlled according to the difference between the two pressures, so that the pressure in the preservation container is increased to keep the same as the in-situ pressure of the core. Since the ambient pressure of the preservation container during the lifting process is gradually reduced, and the in-situ pressure of the core is greater than the ambient pressure of the preservation container during the lifting process, thus pressurization measures can be used.

Figure 18:
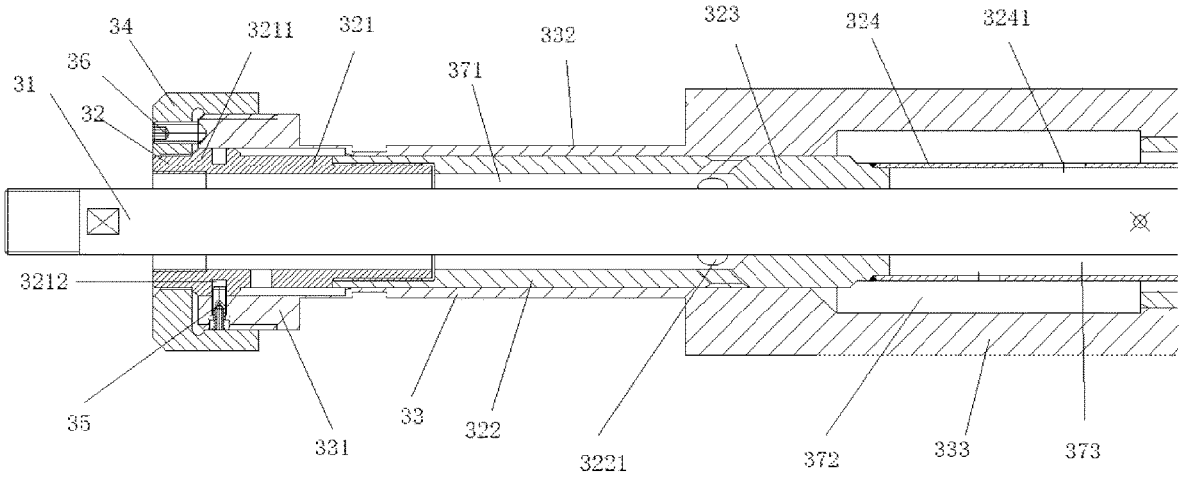
FIG. 18. The schematic diagram of the liquid channel before starting.
Figure 19:
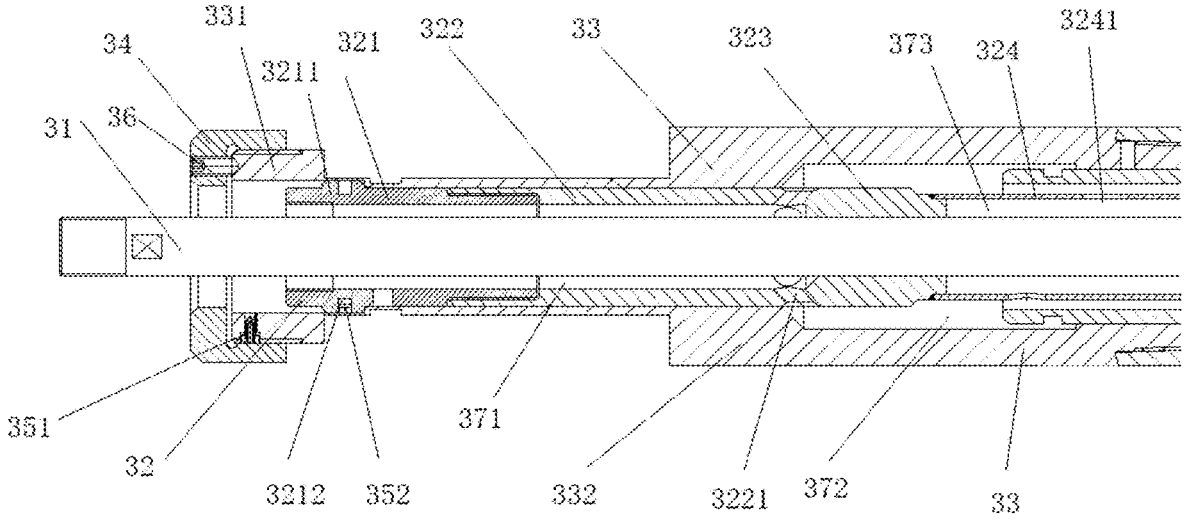
FIG. 19. The schematic diagram of the liquid channel after starting.

As shown in FIGS. 18 and 19, the drive module includes a lock body 33, which penetrates back and forth. The lock body 33 consists sequentially of a locking section 331, a sealing section 332, and a liquid channel section 333 from back to front. There is a shear pin hole on the side wall of the locking section 331, which is a through hole. The locking rod 32 is also comprised, and it penetrates back and forth. The locking rod 32 is inside the lock body 33. The locking rod 32 includes a connecting section 321, an outflow section 322, a sealing section 323 and an inflow section 324 from back to front. The connecting section 321 is threadedly connected with the outflow section 322. The sealing section 323 and the inflow section 324 are welded. There is a groove 3212 on the outer wall of the connecting section 321, which is an annular groove. The starting mechanism also includes a shear pin 35 whose length is greater than the depth of the shear pin hole, and the shear pin 35 is in the shear pin hole and groove 3212. The side wall of the outflow section 322 is provided with an outflow hole 3221, which is inclined forward from the inside to the outside. There are multiple outflow holes 3221, and these holes 3221 are evenly distributed along the radial circumference. The side wall of the inflow section 324 is provided with an inflow hole 3241. There are multiple inflow holes 3241, and these holes 3241 are distributed in front and back on different sides. The starting mechanism also includes a central rod 31, which is in the locking rod 32. The inner diameter of the sealing section 332 is equal to the outer diameter of the closed section 323 and the outflow section 322. The inner diameter of the liquid channel section 333 is greater than the outer diameter of the locking rod 32, and the inner diameters of the connecting section 321, the outflow section 322 and the inflow section 324 are greater than the outer diameter of the central rod 31. The inner diameter of the closed section 323 is equal to the outer diameter of the central rod 31, and the axial distance from the front end of the sealing section 332 to the rear end of the lock body 33 is less than the axial distance from the front end of the closed section 323 to the rear end of the lock body 3. The inner wall of the liquid channel section 333 and the outer wall of the inflow section 324 enclose the inner cavity 372 of the liquid channel section. The inner wall of the inflow section 324 and the outer wall of the center rod 31 enclose the inner cavity 373 of the inflow section. The outer wall of the center rod 31, the inner wall of the outflow section 322 and the inner wall of the connecting section 321 enclose the inner cavity 371 of the outflow section. The inner cavity 372 of the liquid channel section is communicated with the inner cavity 373 of the inflow section by the inflow hole 3241. The inner diameter of the locking section 331 is greater than the inner diameter of the sealing section 332, the outer wall of the connecting section 321 is provided with a convex part 3211, whose outer diameter is greater than the inner diameter of the sealing section 332. The outer diameter of the connecting section 321 in front of the convex part 321 is equal to the inner diameter of the sealing section 332, and the groove 3212 is on the convex part 3211. The starting mechanism also includes a lock nut 34, which is behind the lock body 33, and penetrates back and forth. The central rod 31 passes through the inner cavity of the lock nut 34, and the front end of the lock nut 34 is threadedly connected with the rear end of the lock body 33. The shear pin hole opens at the rear end thread of the lock body 33. The radial distance from the inner wall of the lock nut 34 to the bottom of the groove 3212 is not less than the length of the shear pin 35. The lock nut 34 includes a fixing section and a threaded section. The outer diameter of the connecting section 321 behind the convex part 3211 is shorter than the inner diameter of the fixing section, and also shorter than the outer diameter of the convex part 3211, while the inner diameter of the threaded section is equal to the outer diameter of the locking section 331. Said lock nut is axially provided with a locking hole A, which is the shear pin hole. The lock body 33 has a locking hole B on the rear face, which is a blind hole. The locking hole A and the locking hole B are paired. A fixing screw is also included, whose length is greater than the depth of the locking hole A. The fixing screw 36 is in the locking hole A, and the front end of the fixing screw 36 is inserted into the locking hole B through the locking hole A.

Before starting, the shear pin 35 is inserted into the groove 3212 through the shear pin hole. The axial distance from the outer wall opening of the outflow hole 3221 to the rear end of the lock body 33 is less than the axial distance from the rear end of the liquid channel section 333 to the rear end of the lock body 3. The outer wall opening of the outflow hole 221 is sealed by the sealing section 332, and the fluid cannot flow out. When the hydraulic pressure provided by the rear mud pump reaches the starting value, and crashes the rear end of locking rod 32, the shear pin 35 is cut. Thereby, the shear pin 35 is broken into a shear pin head 351 and a shear pin tail 352. The shear pin head 351 is in the shear pin hole, while the shear pin tail 352 is in the groove 3212. The locking rod moves forward. The axial distance from the outer wall opening of the outflow hole 3221 to the rear end of the lock body 33 is greater than the axial distance from the rear end of the liquid channel section 333 to the rear end of the lock body 3. The inner cavity 371 of the outflow section 322 and the inner cavity 372 of the liquid channel section are in communication through the outflow hole 3221, and thus the liquid channels are communicated. The liquid enters the liquid channel and flows to the front, to drive the hydraulic motor and cool the drill bit.

The shearing pin head 351 includes a big head and a small head, and the big head faces outward. The outer diameter of the big head is greater than that of the small head. The shear pin hole includes an outer section and an inner section. The aperture of the outer section is not less than the outer diameter of the big head, and the aperture of the inner section is not less than the outer diameter of the small head of the shear pin head. The aperture of the inner section is less than the outer diameter of the big head. The depth of the outer section is not less than the length of the big head, and the sum of the length of the small head and the shear pin tail 352 is greater than the depth of the inner section.

The outer diameter of the convex part 3211 in the connecting section 321 is 56 mm, the inner diameter is 36 mm, and the total length is 106 mm. The outer diameters of the connecting section 321 in front of and behind the convex part 3211 are both 50 mm. The depth of the groove 212 is 6 mm. The distance from the rear end of the convex part 3211 to the rear end of the connecting section 321 is 15 mm. The distance from the front end of the groove 212 to the rear end of the connecting section is 27.8 mm. The width of the groove 3212 is 5.5 mm, and the distance from the front end of the groove 3212 to the front end of the connecting section 321 is 73 mm. The side wall of the connecting section 321 is also provided with a through hole with an aperture of 8 mm. The distance from the center of the through hole to the front end of the connecting section 321 is 65 mm, and the outer diameter of the thread at the front end of the connecting section 321 is 43 mm, the thread is M45×1.5 mm. The length of threaded connection between the connecting section 321 and the outflow section 322 is 39 mm.

The outer diameters of the outflow section 322 and the closed section 323 are both 50 mm, the inner diameter of the outflow section 322 is 36 mm, and the diameter of the outflow hole 3221 is 8 mm. The angle between the outflow hole 3221 and the axial direction is 45°. The distance from the front end of the outer wall opening of the outflow hole 3221 to the rear end of the outflow section 322 is 152 mm. There are six outflow holes 322, and the total length of the outflow section 322 and the closed section 323 is 196 mm. The inner diameter of the closed section 323 is 25 mm, and the diameter of the inflow hole 3241 is 16 mm. There are four inflow holes, which are respectively arranged on four sides. The distances between the centers of the four inflow holes 3241 and the back end of the inflow section 24 is 39 mm, 55 mm, 71 mm and 87 mm, respectively. The inner diameter of the inflow section 24 is 40.5 mm, the outer diameter of the inflow section 24 is 44.5 mm, and the outer diameter of the central rod 31 is 25 mm.

The outer diameter of the locking section 331 is 82 mm, and the inner diameter is 56 mm. The distance from the center of the shear pin hole to the rear end of the locking section 331 is 8 mm. The length of the locking section 331 is 56 mm, the outer diameter of the shear pin hole is 8 mm, and the depth is 5 mm. The inner diameter of the shear pin hole is 5 mm, and the depth is 8 mm. The outer diameter of the sealing section 332 is 99.6 mm, the inner diameter is 50 mm, and the length of sealing section 32 is 176 mm. The inner diameter of the liquid channel section 333 is 70 mm.

The total length of the shear pin 35 is 16.5 mm. The length of the big end of the shear pin head 351 is 3.5 mm, and the outer diameter is 7 mm. The outer diameter of the small end of the shear pin head 351 is 4.8 mm. The sum of the length of the small end of the shear pin head 351 and the shear pin tail is 13 mm.

Certainly, there still may be various other examples of the present invention. Without department from the spirit and the essence of the present invention, those skilled in the art can make various corresponding changes and modifications according to the present invention, which should be within the scope of the claims of the present invention.

The invention claimed is:

1. A core sampling and preservation system, comprising a drive module, a preservation module, and a core sampling module that are sequentially connected, wherein the core sampling module comprises a core drilling tool and a core sample storage compartment, the preservation module comprises a core sample preservation container, and the drive module comprises a core drill having a liquid channel;

the core drilling tool comprises a coring drill tool, a core catcher, an inner core pipe an outer core pipe, and a hollow drill bit connected to a lower end of the outer core pipe;

wherein the core catcher comprises an annular base and a plurality of claws, the annular base is coaxially mounted on an inner wall of a lower end of the inner core pipe, and the plurality of claws are uniformly arranged on the annular base, wherein a lower end of each claw is connected with the annular base, and an upper end of each claw is closed inward, the lower end of the inner core pipe extends to a bottom of the outer core pipe, and the inner core pipe is in a clearance fit with the outer core pipe, wherein the core sample storage compartment comprises a rock core barrel, a drilling machine outer cylinder, a flap valve, and a trigger mechanism, the flap valve comprises a valve seat and a sealing flap, the valve seat is coaxially mounted on an inner wall of the drilling machine outer cylinder, and one end of the sealing flap is movably connected to the outer sidewall of the upper end of the valve seat, a top of the valve seat is provided with a valve port sealing surface matched with the sealing flap, wherein the rock core sample preservation container comprises an inner core barrel, an outer core barrel, and an energy storage device, the outer core barrel is sleeved on the inner core barrel, the upper end of the inner core barrel is communicated with a liquid nitrogen storage tank located in the outer core barrel, and the energy storage device is in communication with the outer core barrel, and the outer core barrel is provided with a flap valve, wherein the liquid channel includes a liquid channel starting mechanism consisting of a lock body, a locking rod, a shear pin, and a central, the lock body extends from the front to the back, and the lock body is sequentially composed of a locking section, a sealing section, and a liquid channel section from back to front, a side wall of the locking section is provided with a shear pin hole that is a through hole, the locking rod extends from the front to the back, and is disposed in the lock body, the locking rod sequentially comprises a connecting section, an outflow section, a closed section, and an inflow section from back to front, the an outer wall of the connecting section is provided a groove, a length of the shear pin is greater than a depth of the shear pin hole on the side wall of the lock body, the shear pin is in the shear pin hole and the groove, the side wall of the outflow section is provided with an outflow hole, and the side wall of the inflow section is provided with an inflow hole, the central rod is disposed in the locking rod, an inner diameter of the sealing section is equal to an outer diameter of the closed section, an inner diameter of the liquid channel section is greater than an outer diameter of the locking rod, and inner diameters of the connecting section, the outflow section and the inflow section are greater than an outer diameter of the central rod, an inner diameter of the closed section is equal to the outer diameter of the central rod, and an axial distance from a front end of the sealing section to a rear end of the lock body is less than an axial distance from a front end of the closed section to the rear end of the lock body, an inner cavity of the liquid channel section is in communication with an inner cavity of the inflow section by the inflow hole, the shear pin is inserted into the groove through the shear pin hole, an axial distance from an outer wall opening of the outflow hole to the rear end of the lock body is less than the axial distance from a rear end of the liquid channel section to the rear end of the lock body.

2. The core sampling and preservation system according to claim 1, wherein the core sample preservation container further comprises an electric heater, a temperature sensor, an electric control valve arranged between the inner core barrel and the liquid nitrogen storage tank, a pressure sensor, and a three-way stop valve arranged between the energy storage device and the outer core barrel, and two ways of the three-way stop valve are respectively connected with the energy storage device and the outer core barrel, while the third way of the three-way stop valve is connected with a pressure relief valve, and the stop valve is an electrically controlled valve, the temperature sensor and the pressure sensor are connected to the processing unit, and the electric heater, the electric control valve and the three-way stop valve are all controlled by the processing unit, the electric heater is configured to heat the inside of the outer core barrel, the temperature sensor is configured to detect the temperature in the preservation container, and the pressure sensor is configured to detect the pressure in the preservation container.

3. The core sampling and preservation system according to claim 1, wherein drill bit comprises an inner drill bit and an outer drill bit, the inner drill bit being installed in the outer drill bit, wherein three first-stage blades are arranged at equal intervals in a circumferential direction on a lower end of the inner drill bit, and three second-stage blades are arranged at equal intervals in a circumferential direction on an outer sidewall of the outer drill bit, and both the three first-stage blades and the three second-stage blades are provided with coolant circuit holes.

4. The core sampling and preservation system according to claim 1, wherein the outer core pipe and the outer wall of the drill bit are both provided with a spiral groove, and the spiral groove on the drill bit is continuous with the spiral groove on an outer core tube.

5. The core sampling and preservation system according to claim 1, wherein each of the plurality of claws comprises a vertical arm and a tilt arm which are integrally manufactured, a lower end of the vertical arm is connected with the annular base, an upper end of the vertical arm is connected with a lower end of the tilt arm, the upper end of the tilt arm is a free end, and the tilt arm is configured to tilt inward from bottom to top.

6. The core sampling and preservation system according to claim 1, wherein the sealing valve flap includes an elastic sealing ring, an elastic connecting strips, a plurality of sealings, and a plurality of locking strips arranged in parallel, wherein the elastic connecting strip connects the plurality of locking strips in series, and the elastic sealing ring loops the plurality of locking strips together to form an integral structure, each locking strip is provided with a groove adapted to receive the elastic sealing ring, two adjacent locking strips have one of the plurality of sealings arranged therebetween, one end of the valve flap is movably connected to the upper end of the valve seat through a limit hinge, and the valve flap is attached to the outer wall of the inner coring barrel.

7. The core sampling and preservation system according to claim 1, wherein the inner wall of the outer coring barrel is provided with a sealing cavity, and a flap plate is located in the sealing cavity, and the sealing cavity is in communication with the inner coring barrel.

8. The core sampling and preservation system according to claim 1, wherein the electric heater is a resistance wire, embedded in the inner wall of the outer core barrel, and is coated with an insulating layer, a graphene layer is covered on the inner wall of the inner core barrel, and the upper part of the inner core barrel is filled with a drip film-forming agent.

9. The core sampling and preservation system according to claim 1, wherein the inner diameter of the locking section is greater than the inner diameter of the sealing section, the outer wall of the connecting section has a convex part, whose outer diameter is greater than the inner diameter of the sealing section, the outer diameter of the connecting section in front of the convex part is equal to the inner diameter of the sealing section, and the groove is disposed in the convex part, the outflow hole is inclined forward from the inside to the outside, the connecting section is connected with the outflow section, and the closed section and the inflow section are welded together.

10. The core sampling and preservation system according to claim 9, further comprises a lock nut disposed behind the lock body, the central rod extends through the inner cavity of the lock nut, and the front end of the lock nut is threadedly connected with the rear end of the lock body.

* * * * *